US010100544B2

(12) United States Patent
Crocker et al.

(10) Patent No.: US 10,100,544 B2
(45) Date of Patent: Oct. 16, 2018

(54) MOLDING SYSTEM FOR SWIMMING POOL COPING

(71) Applicant: 2214099 Ontario Limited, Brantford (CA)

(72) Inventors: Howard Crocker, Brantford (CA); Steve Snyder, Brantford (CA)

(73) Assignee: 2214099 Ontario Limited, Brantford, Ontario (CA)

( * ) Notice: Subject to any disclaimer, the term of this patent is extended or adjusted under 35 U.S.C. 154(b) by 0 days.

(21) Appl. No.: 15/835,828

(22) Filed: Dec. 8, 2017

(65) Prior Publication Data

US 2018/0163421 A1 Jun. 14, 2018

Related U.S. Application Data

(60) Provisional application No. 62/431,572, filed on Dec. 8, 2016.

(51) Int. Cl.
*E02D 27/00* (2006.01)
*E04H 4/14* (2006.01)

(52) U.S. Cl.
CPC ..... *E04H 4/141* (2013.01); *E04H 2004/147* (2013.01)

(58) Field of Classification Search
CPC ..... E04H 4/141; E04H 4/142; E04H 4/148; E04H 2004/147
See application file for complete search history.

(56) References Cited

U.S. PATENT DOCUMENTS

| | | | | |
|---|---|---|---|---|
| 4,457,119 | A | 7/1984 | Dahowski | |
| 4,574,017 | A * | 3/1986 | Stegmeier | E04H 4/141 156/247 |
| 4,603,521 | A | 8/1986 | Engelhart | |
| 4,625,343 | A | 12/1986 | Bumgarner, Sr. | |
| 4,967,424 | A | 11/1990 | Stegmeier | |
| 5,330,151 | A | 7/1994 | Boyack | |
| 6,260,313 | B1 | 7/2001 | Stegmeier | |
| 6,758,025 | B2 | 7/2004 | Haberler | |
| 7,546,713 | B2 | 6/2009 | Bradley | |
| D689,208 | S * | 9/2013 | Crocker | D25/125 |
| 9,109,373 | B1 | 8/2015 | Stegmeier, Jr. | |
| 9,476,215 | B2 | 10/2016 | Baldoni et al. | |
| 9,574,358 | B2 * | 2/2017 | Deason | E04G 13/06 |
| 2004/0074159 | A1 | 4/2004 | Irgang et al. | |
| 2004/0123380 | A1 | 7/2004 | Shebek | |
| 2016/0115701 | A1 | 4/2016 | Baldoni et al. | |

* cited by examiner

*Primary Examiner* — Brian D Mattei
(74) *Attorney, Agent, or Firm* — Kagan Binder, PLLC

(57) ABSTRACT

The system includes support sections and locking clips. Each support section has an L-shaped base portion, a back portion, and a flange for insertion into a slot in a track around the pool. so that when the track flange is inserted in the slot, part of the base portion extends down near the pool wall, part of the base portion extends away from the pool wall to a distal end, the back portion being attached to the distal end, the back portion extends above the track, and the locking hole is proximate to the slot. Each locking clip has a protrusion sized and configured to extend through the locking hole in the support section and into the slot in the track so that the clip abuts and supports the support section and is locked into place by a friction fit between the protrusion and the track.

8 Claims, 6 Drawing Sheets

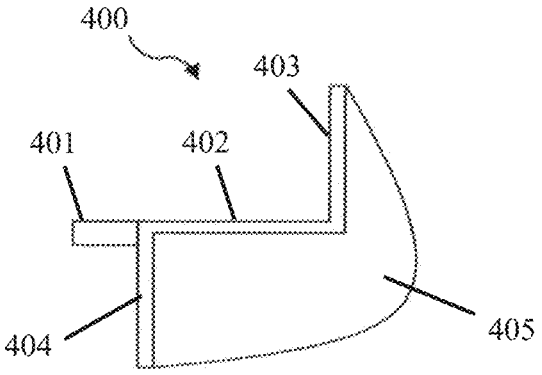
FIG. 4
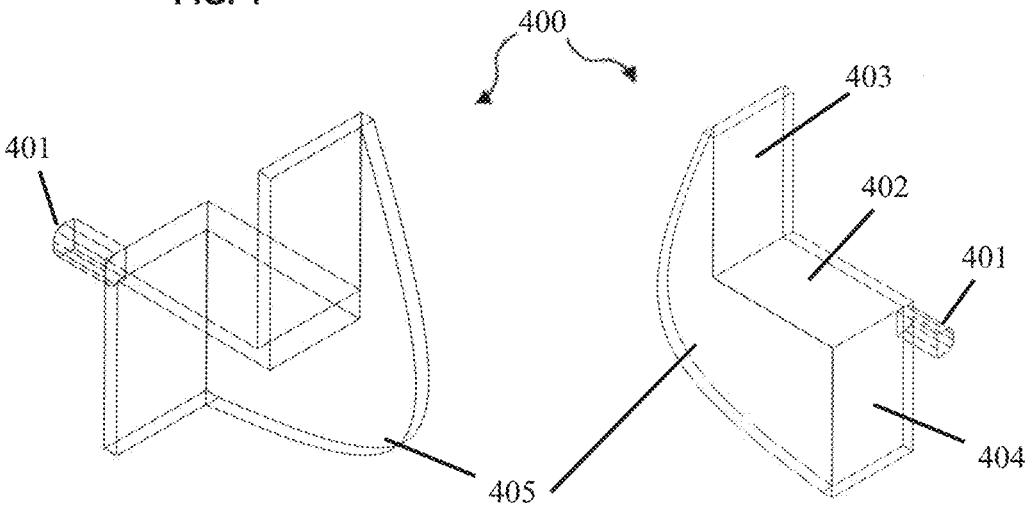
FIG. 5
FIG. 6

MOLDING SYSTEM FOR SWIMMING POOL COPING

PRIORITY CLAIM

This application claims priority to U.S. Provisional Patent Application No. 62/431,572, filed Dec. 8, 2016, the content of which is incorporated herein by reference in its entirety.

FIELD OF THE INVENTION

The present invention relates generally to devices and methods for forming and installing pool coping, and more particularly to devices and methods for forming and installing pool coping using reusable components.

BACKGROUND OF THE INVENTION

Inground, vinyl-lined, swimming pools require a hanger that is placed on the top of the steel panel, to connect the vinyl liner into. Almost every swimming pool has a deck, of some material, around it. This deck is most commonly poured concrete. Traditionally, this transition point would be made of aluminum or PVC (this is commonly called "coping"). Pool forms are typically made of Styrofoam, as has been the case for over a decade. The Styrofoam forms are disposed of after each installation.

SUMMARY OF THE INVENTION

The invention provides molding system for forming and installing coping for a pool. The pool has a bottom and walls forming an interior region for holding water. Each wall has an upper end, and the pool has a perimeter defined by the upper ends of the walls. The upper end of the walls has a track attached that extends around the perimeter of the pool. The track has a lateral slot facing the interior region of the pool.

The system includes multiple support sections and multiple locking clips. Each support section has an L-shaped base portion and a back portion. The base portion has a locking hole extending through it. The support section has a track flange configured to be inserted into the slot in the track so that when the track flange is inserted in the slot (a) a first sub-portion of the base portion extends vertically down proximate to the pool wall, (b) a second sub-portion of the base portion extends away from the pool wall from a proximal end towards the interior region of the pool to a distal end, the back portion being attached to the distal end, (c) the back portion extends vertically above the track, and (d) the locking hole is proximate to the slot in the track. Each locking clip has a protrusion sized and configured to extend through the locking hole in the support section and into the slot in the track so that the clip abuts and supports the support section and is locked into place by a friction fit between the protrusion and the track.

The system preferably also includes a molding form configured to rest on the base portions of support sections near the distal end of the base portions and extend up along the back portions of the support sections. The molding form is configured to receive and form uncured concrete. After the concrete is cured, the system is removable by unlocking and removing the locking clips, and removing the support sections and molding form.

The track flange may include two or more of teeth, where the locking hole is located between two of the teeth.

The back portion and base portion of each supporting section may be integrally formed and made of metal.

One or more of the support sections may be an extended support section with multiple locking holes, each of the locking holes being proximate to the slot in the track when the track flange is inserted in the slot. The locking holes are spaced laterally apart from each other so that the extended support section may be secured to the track by a corresponding number of locking clips.

Each locking clip may have a base portion and a back portion, and be configured so that when the track flange is inserted in the slot, the protrusion of the locking clip is insertable though the locking hole in the support section into the slot in the track and rotatable so that the locking clip can be rotated to form the friction fit between the protrusion and the track while the base portion and back portion rotate to engage the second sub-portion of the base portion of the support section and the back portion of the support section respectively.

The present invention also provides a molding system for a swimming pool coping having a track for receiving a pool liner. The molding system includes multiple support sections for supporting a molding form for forming concrete coping and a multiple locking clips. Each support section has a top surface for supporting the molding form and a backing flange positioned proximate to an end of the support section extending perpendicularly from the top surface. Each support section has a track flange that is engageable with the pool liner track and a locking hole through the support section proximate to a portion of the pool liner track. The system includes at least one locking clip for each support section, each locking clip having a protrusion sized and configured to extend through the locking hole in the support section and into the pool liner track so that the clip abuts and supports the support section and is locked into place by the protrusion inserted in the pool liner track.

The invention also provides a method of forming coping for a swimming pool. The pool has a bottom and walls forming an interior region for holding water. Each wall has an upper end, and the pool has a perimeter defined by the upper ends of the walls. The upper ends of the walls have an attached track extending around the perimeter, the track having a lateral slot facing the interior region of the pool. The method employs multiple support sections, each support section having an L-shaped base portion and a back portion. The base portion has a locking hole through it, and has a track flange configured to be inserted into the slot in the track so that when the track flange is inserted in the slot, (a) a first sub-portion of the base portion extends vertically down proximate to the pool wall, (b) a second sub-portion of the base portion extends away from the pool wall from a proximal end towards the interior region of the pool to a distal end, the back portion being attached to the distal end, (c) the back portion extends vertically above the track, and (d) the locking hole is proximate to the slot in the track. The method also employs multiple locking clips, each locking clip having a protrusion sized and configured to extend through the locking hole in the support section and into the slot in the track so that the clip abuts and supports the support section and is locked into place by a friction fit between the protrusion and the track. The method involves installing the support sections around the perimeter of the pool by, for each support section, inserting the track flange into the slot in the track so that the first sub-portion of the base portion extends vertically down proximate to the pool wall and the back portion extends vertically above the track. Then the protrusion of one of the locking clips is inserted into the locking hole in the support section, locking the locking clip to hold the support section in place. A molding form is placed around the perimeter of the pool so that the molding form rests on the base portions of support sections near the distal end of the base portions, and extends up along the back portions of the support sections. Uncured concrete is then poured around the perimeter of the pool so that the concrete abuts the molding form. After the concrete has cured, for each support section, the locking clip is unlocked and removed, and the support section is removed. Then, the molding form is removed from the cured concrete.

BRIEF DESCRIPTION OF THE DRAWINGS

FIG. 4 is a side view of a locking clip.

FIG. 5 is a rear perspective view of the locking clip of FIG. 4.

FIG. 6 is a front perspective view of the locking clip of FIG. 4.

DETAILED DESCRIPTION OF THE INVENTION

The present invention provides a system and method for forming and installing coping for a swimming pool. The pool has a bottom and walls that together define an interior region that holds water. In the case of a pool with a vinyl liner, the upper ends of the walls have a track attached to them that extends around the perimeter. The track has a lateral slot facing the interior region of the pool for purposes of attaching the liner.

Figure 1:
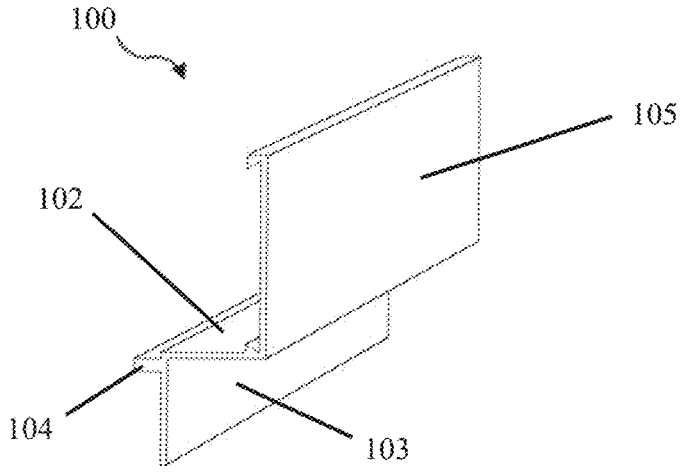
FIG. 1 is a rear perspective view of a support section.
Figure 2:
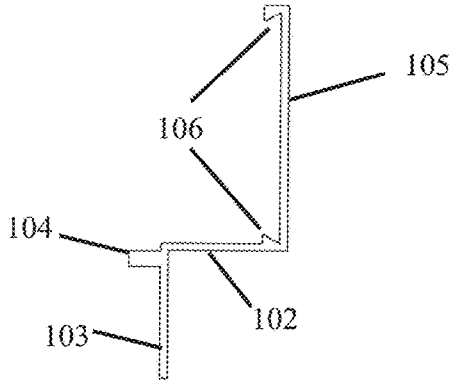
FIG. 2 is a side view of the support section of FIG. 1.

FIG. 1 shows an embodiment of a support section 100, which may also be referred to as a "form". Such support sections are generally made from metal, such as aluminum. Different support sections may have different lateral extents. Longer support sections are generally used where the pool track has a relatively long straight portion. Where the upper walls curve, for example to form corners, multiple support sections with a small lateral extent are preferably used. For example, a small support section may have a lateral extent of about 3 inches or 8 cm.

Figure 10:
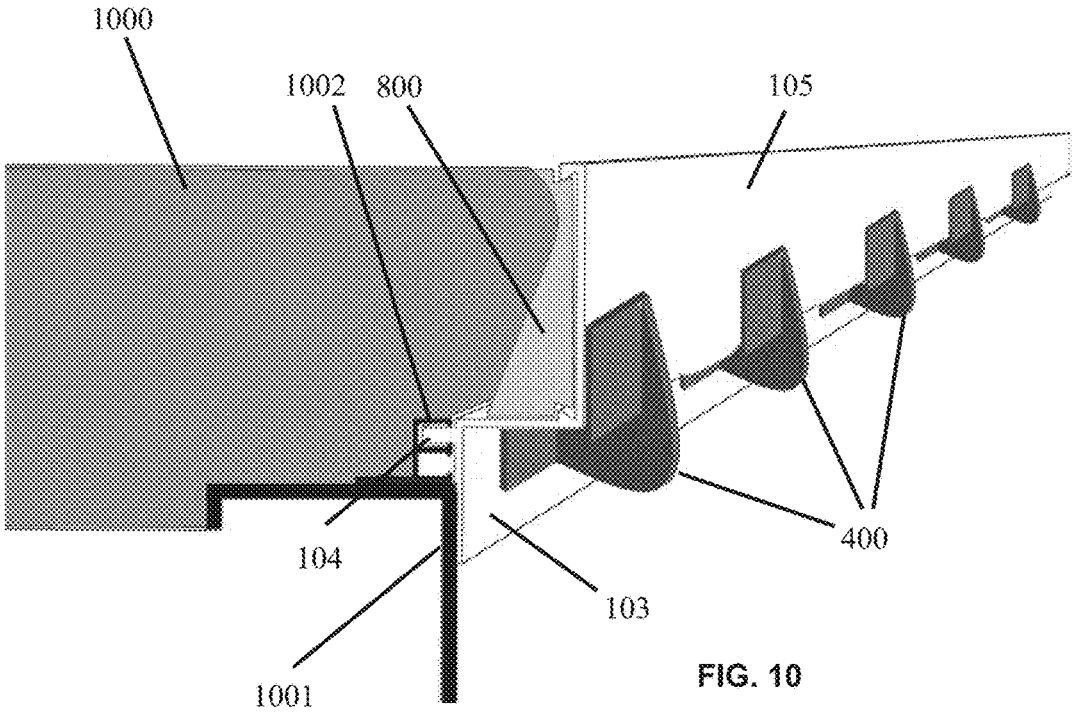
FIG. 10 shows an extended support section secured to a pool liner track by five locking clips with concrete adjacent to a molding form supported by the support section.

Each support section 100 has an L-shaped base portion 102, 103 and a track flange 104 configured to be inserted into the slot in the track. When the track flange is inserted in the slot in the track, for example as shown in FIG. 10, then a lower portion 103 of the base portion extends vertically down beside the pool wall 1001 so that it abuts the pool wall 1001. An upper portion 102 of the base extends away from the pool wall, perpendicular to the lower portion 103 and towards the interior region of the pool to a distal end. A back portion 105 of the support section 100 extends vertically above the track from the distal end of the upper portion 102 of the base portion. Preferably all the portions of the support section are integrally formed from metal, such as aluminum.

Figure 3:
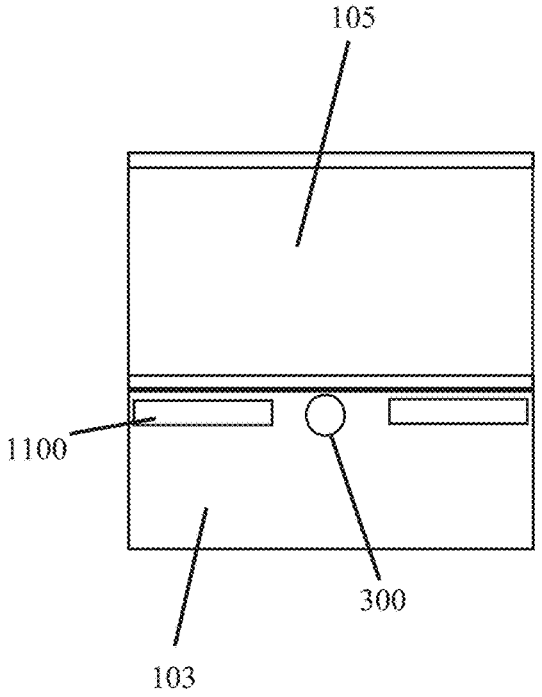
FIG. 3 is a front plan view of the support section of FIG. 1.
Figure 11:
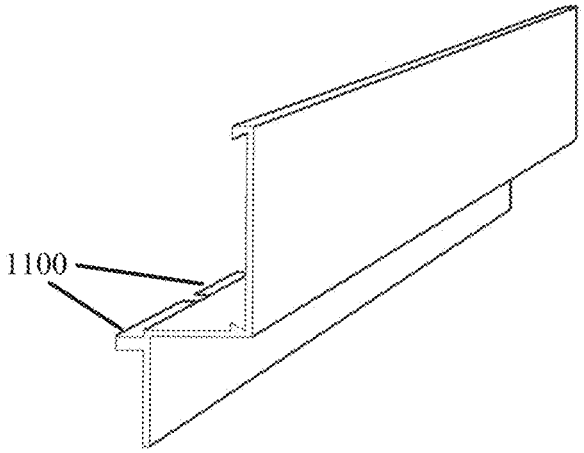
FIG. 11 is a rear perspective view of a support section.

As shown in FIGS. 3 and 11, the track flange 104 has multiple "teeth" 1100. In a smaller support section 100, the track flange 104 may have two teeth 1100 with a hole 300 therebetween. In longer (extended) support sections (e.g. as in FIGS. 7 and 10), the track flange may have more than two teeth and have multiple holes. For example, the locking holes may be spaced about six inches apart from each other along the lateral extent of the extended support section between teeth 1100 in the track flange.

Each supporting section has at least one hole 300, as shown in FIG. 3, through the lower portion of the base of the support section so that, when the track flange is inserted in the slot in the track, the hole is adjacent to the slot 1002 in the track. This facilities the use of locking clips 400 to secure the support section to the pool track. FIGS. 4-6 show views of a preferred embodiment of a locking clip 400.

Figure 7:
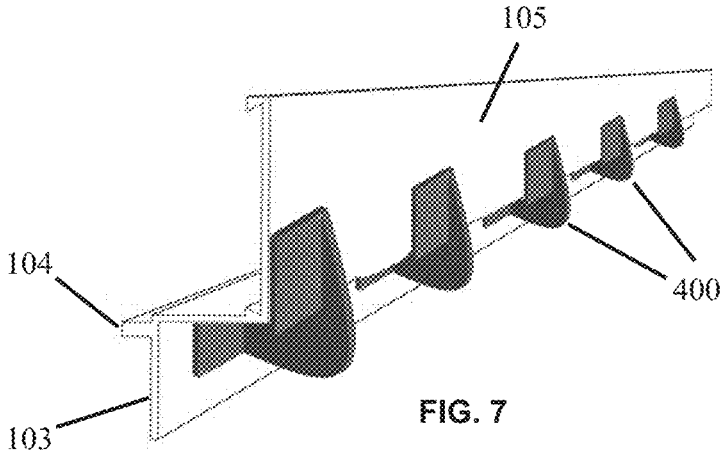
FIG. 7 is a rear perspective view of an extended support section with five locking clips locking the support section to a pool track (not shown).

The locking clip 400 has a protrusion 401 that is used to attach the clip to the pool track. The locking clip 400 has a base portion including a lower vertical portion 404 and an upper flat portion 402, and a vertical back portion 403. The portions of the locking clip 400 are sized and configured so that the locking clip 400 can be placed with the protrusion 401 inserted through the hole in the support section when the track flange is inserted in the slot in the track, as shown in FIGS. 7 and 10, so that the lower vertical portion 404 of the locking clip 400 abuts the lower portion 103 of the base portion, the upper flat portion 402 abuts and supports the bottom of the upper portion 102 of the base, and the back portion 403 abuts and supports the back portion 105 of the support section.

The protrusion 401 is sized and configured to be inserted through the hole in the support section and into the slot in the track when the track flange is inserted in the slot in the track. In preferred embodiments, the hole in the support section is placed between two "teeth" 1100 of the track flange 104. A smaller support section may have a single hole between two such teeth so that a single locking clip 400 can be used to secure the support section to the pool track.

In some embodiments, the locking clips 400 may be referred to as twist and lock clips. The protrusion 401 may have two straight sides, and one rounded side, and is made oblong—i.e. the protrusion 401 may have a rectangular cross section with one end rounded as shown in FIG. 6. This rectangle is configured to slide into the track sideways. The width (the shorter side) slides through the slot (horizontal opening) in the track. Then, when the clip is turned (rotated) to bring the back portion 403 of the clip into abutment with the back portion 105 of the support section, the protrusion 401 rotates so that its longer dimension is vertical, and is therefore somewhat larger than the slot in height, so it locks in place. The round side is then pushed into the track material, resulting in a secure friction fit. The round side allows it to mate with various manufacturers' tracks, by ramping up the tension as it twists and spreads the pressure, thereby locking it into place.

The protrusion extends from the lower vertical portion 404 of the locking clip 400 near the upper flat portion 402 and towards one side of the lower vertical portion 404 to allow the protrusion 401 to be inserted through the hole in the locking clip 400, into the track slot, when the locking clip is positioned sideways (relative to the orientation shown in FIGS. 4-7) with the side flange 405 of the locking clip 400 parallel to and spaced apart from the upper portion 102 of the base of the support section. Then, the locking clip 400 can then be rotated, for example by gripping the side flange 405, to bring the portions of the clip into proximity and abutment with the portions of the support section as described, and as shown in FIGS. 7 and 10. It will be evident to skilled persons that other forms of locking clips could be used to secure such support sections to the pool track.

Figure 8:
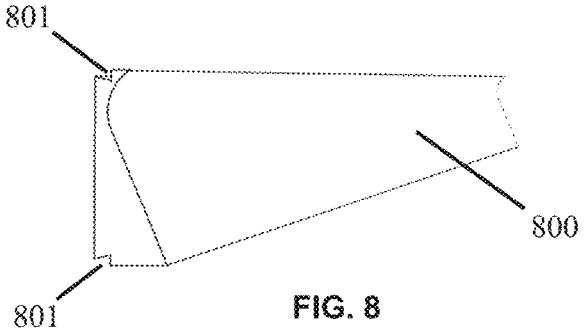
FIG. 8 is a perspective view of a molding form.
Figure 9:
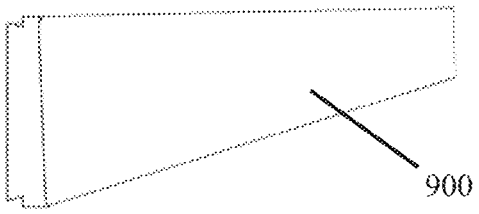
FIG. 9 is a perspective view of another molding form.

The system employs a molding form, which is preferably made of rubber. Embodiments of such a form are shown in FIGS. 8 and 9. The form 800 of FIG. 8 is also shown in FIG. 10, where concrete 1000 has been poured adjacent to the form 800. Molding forms can employ different shapes molded into the face of the form in order to form coping with different shapes. Molding forms 800 preferably include upper and lower notches 801 as shown in FIG. 8. The support section preferably has corresponding notches 106, and the height of the molding form is comparable to the height of the back portion 105 of the support sections so that the molding form can be pressed into place, abutting the inner wall of the back portion 105 of the support sections, with the notches being configured to maintain the support form in position.

In forming pool coping, support sections are placed around the perimeter of the pool with their track flanges 104 inserted in the slot in the track. The sections may be spaced apart from neighboring support sections, for example where multiple short support sections are used around a corner or a curve in the perimeter. Tape is preferably placed on the upper portions 102 of the bases of the support sections so that it stretches between adjacent support sections in order to prevent concrete from falling into the pool during construction. The support sections are secured in place by using one locking clip 401 for each hole in each support section, as discussed above. The molding form is then placed adjacent the inside of the backs 105 of the support sections, as discussed above, so that the molding form extends around the perimeter of the pool. Another construct having a wall (not shown) may be placed around the pool, away from the interior region of the pool, spaced apart from the molding form, to define the outer boundary for the pool coping to be formed.

Then uncured concrete 1000 can be poured adjacent to the molding form and allowed to cure. After the concrete is cured, the locking clips 400 can be removed. This is done by rotating each clip by ninety degrees (clockwise in the figures) and pulling the protrusion of the clip out of the track slot. After the clips for a support section have been removed, the support section can then be removed, along with the molding form, from the cured concrete.

The support sections, clips and molding forms are all designed to be reusable. By employing both extended and relatively narrow support sections, any perimeter shape can be accommodated by a suitable set of support sections, which may be reused in the future to form coping on other pools.

The locking clips 400 may be made of metal or plastic.

For Fiberglass pools, or along edges where there is no track, a long vertical support runs along the bottom of the Form, which keeps the Form vertical. The form height accommodates the Canadian Pool Industry standard thickness of concrete. Small wedge shaped clips 106 hold the rubber form in place. The slot 1308 along the bottom support 1303 allows for a Reusable Form (FIG. 13) to slide onto the Fiberglass Form Support Clip (FIG. 12).

Figure 12:
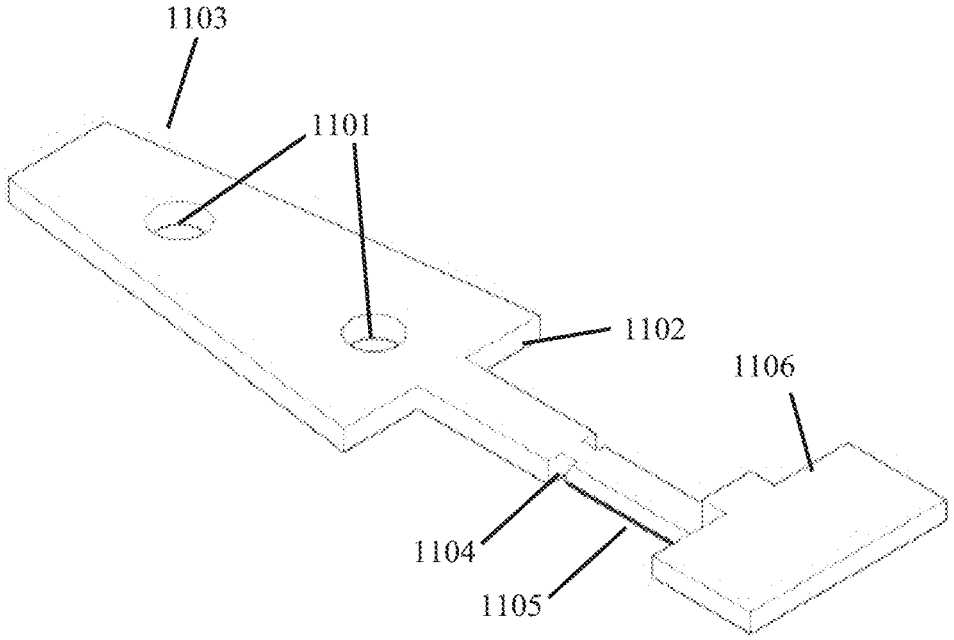
FIG. 12 depicts a Fiberglass Form Support Clip.
Figure 13:
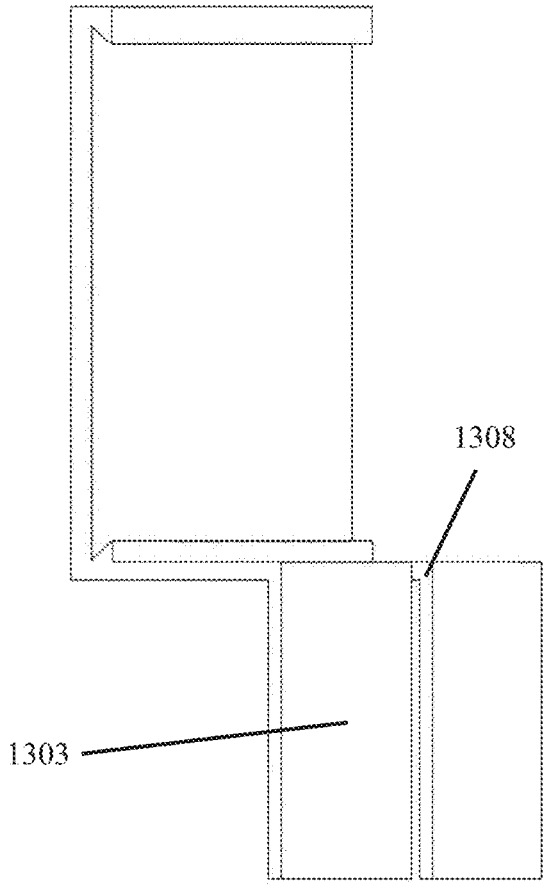
FIG. 13 depicts a vertical support or form for use with a Fiberglass pool.

A Fiberglass Form Support Clip (FFSP) is shown in FIG. 12. The FFSP is attached to the top edge of the pool or step to create a flat support for the Reusable Form, that transfers the horizontal force of the concrete into the base. The FFSP is screwed down to the top coping of the fiberglass pool using one or both of the two holes (1101). A ledge supports the Reusable Form, to sit vertically and to transfer the horizontal force in the bottom of the Reusable Form (1303). The Fiberglass Form Support Clip is intended to remain encased in concrete, while the support ledge (1106) and the shaft (1105) is removed. A straight edge support ensures that when the clip is removed (after the concrete sets), that the inner-end of the clip (1103) remains. A break-point (1104) and a rounded edge on the outer shaft (1105) facilitates the shearing to happen beyond the visible edge of the formed concrete (1000), when the outer-end is twisted.

The abbreviation mm as used herein refers to millimeters (or in the US, "millimeters"). The abbreviation cm as used herein refers to centimeters (or in the US, "centimeters").

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed. Unless expressly stated or otherwise clearly implied herein, the conjunction "or" as used in the specification and claims shall be interpreted as a non-exclusive "or" so that "X or Y" is true when X is true, when Y is true, and when both X and Y are true, and "X or Y" is false only when both X and Y are false.

The words "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art. That is, persons skilled in the art will appreciate and understand that such modifications and variations are, or will be, possible to utilize and carry out the teachings of the invention described herein.

The scope of the claims that follow is not limited by the embodiments set forth in the description. The claims should be given the broadest purposive construction consistent with the description and figures as a whole.

What is claimed is:

1. A molding system for forming and installing coping for a pool, the pool having a bottom and walls forming an interior region for holding water, each wall having an upper end, the pool having a perimeter defined by the upper ends of the walls, the upper ends of the walls having a track attached thereto extending around the perimeter, the track having a lateral slot facing the interior region of the pool, the system comprising:

a plurality of support sections, each support section having an L-shaped base portion and a back portion, the base portion having a locking hole therethrough, and comprising a track flange configured to be inserted into the slot in the track so that when the track flange is inserted in the slot (a) a first sub-portion of the base portion extends vertically down proximate to the pool wall, (b) a second sub-portion of the base portion extends away from the pool wall from a proximal end towards the interior region of the pool to a distal end, the back portion being attached to the distal end, (c) the back portion extends vertically above the track, and (d) the locking hole is proximate to the slot in the track; and a plurality of locking clips, each locking clip having a protrusion sized and configured to extend through the locking hole in the support section and into the slot in the track so that the clip abuts and supports the support section and is locked into place by a friction fit between the protrusion and the track.

2. The system of claim 1 further comprising a molding form configured to rest on the base portions of support sections near the distal end of the base portions, and extend up along the back portions of the support sections, the molding form being configured to receive and form uncured concrete, wherein after the concrete is cured, the system is removable by unlocking and removing the locking clips, and removing the support sections and molding form.

3. The system of claim 1, wherein the track flange comprises a plurality of teeth, wherein the locking hole is located between two of the teeth.

4. The system of claim 1, wherein the back portion and base portion of each supporting section are integrally formed and are made of metal.

5. The system of claim 1, wherein one or more of the support sections is an extended support section comprising a plurality of locking holes, each of the locking holes being proximate to the slot in the track when the track flange is inserted in the slot, the locking holes being spaced laterally apart from each other so that the extended support section may be secured to the track by a plurality of locking clips.

6. The system of claim 1, wherein each locking clip comprises a base portion and a back portion, wherein the locking clip is configured so that when the track flange is inserted in the slot, the protrusion of the locking clip is insertable though the locking hole in the support section into the slot in the track and rotatable so that the locking clip can be rotated to form the friction fit between the protrusion and the track while the base portion and back portion rotate to engage the second sub-portion of the base portion of the support section and the back portion of the support section respectively.

7. A molding system for a swimming pool coping having a track for receiving a pool liner, the molding system comprising a plurality of support sections for supporting a molding form for forming concrete coping and a plurality of locking clips, each support section comprising a top surface for supporting the molding form and a backing flange positioned proximate to an end of the support section extending substantially perpendicularly from the top surface, each support section having a track flange that is engageable with the pool liner track and a locking hole through the support section proximate to a portion of the pool liner track, the system having one locking clip for each support section, each locking clip having a protrusion sized and configured to extend through the locking hole in the support section and into the pool liner track so that the clip abuts and supports the support section and is locked into place by the protrusion inserted in the pool liner track.

8. A method of forming coping for a swimming pool, the pool having a bottom and walls forming an interior region for holding water, each wall having an upper end, the pool having a perimeter defined by the upper ends of the walls, the upper ends of the walls having a track attached thereto extending around the perimeter, the track having a lateral slot facing the interior region of the pool, the method comprising:

providing a plurality of support sections, each support section having an L-shaped base portion and a back portion, the base portion having a locking hole therethrough, and comprising a track flange configured to be inserted into the slot in the track so that when the track flange is inserted in the slot, (a) a first sub-portion of the base portion extends vertically down proximate to the pool wall, (b) a second sub-portion of the base portion extends away from the pool wall from a proximal end towards the interior region of the pool to a distal end, the back portion being attached to the distal end, (c) the back portion extends vertically above the track, and (d) the locking hole is proximate to the slot in the track;

providing a plurality of locking clips, each locking clip having a protrusion sized and configured to extend through the locking hole in the support section and into the slot in the track so that the clip abuts and supports the support section and is locked into place by a friction fit between the protrusion and the track;

installing the support sections around the perimeter of the pool by, for each support section, inserting the track flange into the slot in the track so that the first sub-portion of the base portion extends vertically down proximate to the pool wall and the back portion extends vertically above the track, inserting the protrusion of one of the locking clips into the locking hole in the support section, and locking the locking clip to hold the support section in place;

placing a molding form around the perimeter of the pool so that the molding form rests on the base portions of support sections near the distal end of the base portions, and extends up along the back portions of the support sections;

pouring uncured concrete around the perimeter of the pool so that the concrete abuts the molding form;

allowing the concrete to cure;

after the concrete has cured, for each support section, unlocking and removing the locking clip, and removing the support section; and removing the molding form from the cured concrete.

* * * * *